US008830253B2

(12) United States Patent
Choi et al.

(10) Patent No.: US 8,830,253 B2
(45) Date of Patent: Sep. 9, 2014

(54) DISPLAY DEVICE CAPABLE OF CONTROLLING VIEWING ANGLE AND DRIVING METHOD THEREOF

(75) Inventors: Yong-Seok Choi, Yongin (KR); Jong-Woong Park, Yongin (KR); Joo-Hyung Lee, Yongin (KR); Geun-Young Jeong, Yongin (KR); Dong-Won Lee, Yongin (KR)

(73) Assignee: Samsung Display Co., Ltd., Gheung-Gu, Yongin, Gyeonggi-Do (KR)

( * ) Notice: Subject to any disclaimer, the term of this patent is extended or adjusted under 35 U.S.C. 154(b) by 293 days.

(21) Appl. No.: 13/213,306

(22) Filed: Aug. 19, 2011

(65) Prior Publication Data

US 2012/0098849 A1 Apr. 26, 2012

(30) Foreign Application Priority Data

Oct. 22, 2010 (KR) ..... 10-2010-0103503

(51) Int. Cl.
*G09G 5/02* (2006.01)
*G09G 3/20* (2006.01)

(52) U.S. Cl.
CPC ..... *G09G 3/20* (2013.01); *G09G 220/068* (2013.01)
USPC ..... 345/589

(58) Field of Classification Search
CPC ..... G09G 2320/068; G09G 3/20
See application file for complete search history.

(56) References Cited

U.S. PATENT DOCUMENTS 7,999,775 B2 * 8/2011 Seo et al. ..... 345/87

FOREIGN PATENT DOCUMENTS

| | | |
|---|---|---|
| JP | 2006-276363 | 10/2006 |
| KR | 10-2007-0010552 | 1/2007 |
| KR | 10-2007-0114370 | 12/2007 |
| KR | 10-2008-0023089 | 3/2008 |
| KR | 10-2008-0062680 | 7/2008 |

* cited by examiner

*Primary Examiner* — Kee M Tung
*Assistant Examiner* — Frank Chen
(74) *Attorney, Agent, or Firm* — Robert E. Bushnell, Esq.

(57) ABSTRACT

A viewing angle controllable display device and a driving method thereof. The viewing angle controllable display device includes: an image mixing unit generating a mixed image data signal by mixing an original image data signal, or a gray-adjusted original image data signal, with a protection image data signal that disturbs recognition of the original image; an output image selecting unit receiving the original image data signal or the mixed image data signal, and selecting an image data signal corresponding to an image output to a display panel; and a display panel receiving a data voltage corresponding to the image data signal selected and output from the output image selecting unit through a data drive to display an original image or a mixed image, responding to gate signals sequentially transmitted from a gate driver.

15 Claims, 8 Drawing Sheets

DATA2

DISPLAY DEVICE CAPABLE OF CONTROLLING VIEWING ANGLE AND DRIVING METHOD THEREOF

CLAIM OF PRIORITY

This application makes reference to, incorporates the same herein, and claims all benefits accruing under 35 U.S.C §119 from an application earlier filed in the Korean Intellectual Property Office on Oct. 22, 2010, and there duly assigned Serial No. 10-2010-0103503 by that Office.

BACKGROUND OF THE INVENTION

1. Field of the Invention

The present invention is a display device that can control a viewing angle of a display panel for privacy protection or data preservation of users of the display device or a data terminal, and a driving method thereof. More particularly, the described technology relates generally to a display device for privacy protection that can limit readability from a side view without controlling colors or adding interference pixels to disturb readability in the display panel of the display device of another person, and a driving method thereof.

2. Description of the Related Art

Recently, users of mobile display devices or data terminals such as a portable phone, a personal digital assistant (PDA), and a computer have required data protection against another person, excluding themselves for privacy protection.

Responding to requests such as confidential disclosure and security for data terminals, a display device of the data terminal supports not only a normal viewing angle mode but also a narrow viewing angle mode.

As a method for satisfying a viewing angle control request, a dual viewing angle mode liquid crystal panel having an additional interference sub-pixel has been suggested. A double-structured liquid crystal panel may be an example of a viewing angle control mode liquid crystal panel.

The double-structure liquid crystal panel is formed of a normal panel where color pixels are formed and an interference panel disposed at an upper portion of the normal panel and having interference sub-pixels. The normal panel is used for displaying an image and the interference panel blocks light transmitted toward a side of the panel. The double-structure liquid crystal panel can change a viewing angle of an image by blocking light toward the side using the interference panel.

A viewing angle controllable liquid crystal display device including the double-structure liquid crystal panel selectively drives the interference panel to realize a wide viewing angle mode and a narrow viewing angle mode. That is, the liquid crystal display turns on and turns off the interference panel according to a viewing angle mode.

However, the double-structure liquid crystal panel is unproductive because it requires an additional process, and luminance of an image is significantly reduced because external light needs to pass a doubled layered liquid crystal layer. Further, the double-structure liquid crystal panel is increased in thickness and weight.

As another type of the liquid crystal panel in the viewing angle control mode, a liquid crystal panel using a region division method has been suggested. In the liquid crystal panel, normal color pixels and interference sub-pixels are arranged on the same plane. In the liquid crystal panel using the region division method, color pixels respectively include red, green, and blue normal sub-pixels and interference sub-pixels. Since the interference sub-pixels and the normal color sub-pixels are arranged on the same plane, the thickness and the weight of the liquid crystal panel are not increased. In addition, the liquid crystal panel using the region division method can control a viewing angle with one liquid crystal layer so that decrease of light amount and deterioration of luminance and color purity can be prevented.

However, the viewing angle control mode panel should drive the interference sub-pixels in addition to an existing driving method so that a driving circuit becomes complicated and manufacturing cost is increased.

Thus, in development of a viewing angle controllable display panel, a study for a display panel for privacy protection using a simple driving method without changing luminance of an image and adding an additional manufacturing process is required.

The above information disclosed in this Background section is only for enhancement of understanding of the background of the described technology and therefore it may contain information that does not form the prior art that is already known in this country to a person of ordinary skill in the art.

SUMMARY OF THE INVENTION

The described technology has been made in an effort to provide a display device that can perform privacy or data protection or security protection of a user without having an additional interference pixel or a dual display panel, and a driving method thereof.

In addition, the present invention provides a driving method of a display device that can effectively limit readability of another person at side view of the display panel without adding a complicated driving circuit for driving the display panel of a display device for reinforcement of protection function.

The technical objects to be achieved by the present invention are not limited to the above-mentioned object, and other technical objects that have not been mentioned above will become evident to those skilled in the art from the following description.

A viewing angle controllable display device according to an exemplary embodiment includes a display panel including a plurality of pixels, a gate driver driving the display panel, a data driver transmitting a data voltage according to an image data signal to the display panel, and a signal controller controlling the display panel, the gate driver, and the data driver. The display device further includes an image mixing unit and an output image selecting unit.

The image mixing unit generates a mixed image data signal by mixing an original image data signal or a gray-adjusted original image data signal and a protection image data signal that disturbs recognition of the original image In this case, the original image data signal may be received from an external device and supplied to the image mixing unit.

The output image selecting unit receives the original image data signal or the gray-adjusted original image data signal and the mixed image data signal, and selects an image data signal corresponding to an image output to a display panel.

The display panel receives a data voltage corresponding to the image data signal selected and output from the output image selecting unit through a data drive to display an original image or a mixed image, responding to gate signals sequentially transmitted from a gate driver.

In this case, a viewing angle of the mixed image may be narrower than that of the original image.

In addition, the display panel displaying the mixed image may have a limit of readability in a side-viewed image, and accordingly privacy of a user can be protected and security on an image realized on the display device or data can be protected.

In the present invention, the protection image data signal has a gray value modulated within a gray range adjusted based on gray data of the display panel.

The mixed image data signal is generated by mixing the original image data signal or the gray-adjusted original image data signal and the protection image data signal for each pixel unit or each sub-pixel unit.

The image mixing unit and the output image selecting unit may be integrated to a signal controller or may be provided as additional devices, but it is not restrictive.

In the present invention, the image mixing unit may be formed of a gray adjusting unit that inversely adjusting a gray with respect to an input image data signal and an image combining unit combining modulated images.

In addition, the image mixing unit may further include a storage unit for storing data input to the constituent devices or data output therefrom.

The gray adjusting unit adjusts a gray value of the original image data signal or the protection image data signal within a gray-adjusted gray range based on gray data of the display panel.

The image combining unit generates the mixed image data signal by mixing a protection image data signal having a gray value adjusted by the gray adjusting unit with the original image data signal or an original image data signal having a gray value adjusted by the gray adjusting unit.

In this case, the image combining unit may generate the mixed image data signal by combining the protection image data signal with the original image data signal or the original image data signal having the adjusted gray value for each pixel unit or each sub-pixel unit.

The data stored in the storage unit may include gray data of the display panel, data of the original image data signal, data of the original image data signal having the gray-adjusted gray value, data of the protection image data signal, data of a protection image data signal having the gray-adjusted gray value, and a look up table storing data of an image data signal for each dot or each pixel, but it is not restrictive.

In the present invention, the display panel may be preferably a liquid crystal display panel or a flat display panel, but it is not restrictive.

In the present invention, a controller may generate and transmit an image selection control signal that controls selection of an image data signal to be display on the display panel to the output image selecting unit.

A driving method of a viewing angle controllable display device according to another exemplary embodiment includes: generating a mixed image data signal by mixing an original image data signal or a gray-adjusted original image data signal and a protection image data signal that disturbs recognition of the original image; selecting an output image data signal corresponding to an image output on the display panel among the original image data signal or the gray-adjusted original image data signal and the mixed image data signal; and displaying an image according to the selected output image data signal on the display panel.

In this case, the protection image data signal has a gray value modulated within a gray range modulated based on gray data of the display panel.

When a mixed image data signal is selected as an output image data signal, a viewing angle of an image displayed according to the mixed image data signal is limited.

In addition, the image displayed according to the mixed image data signal has a limit of readability in a side-viewed image.

A viewing angle of the image displayed according to the mixed image data signal may be narrower than that of an original image.

In the driving method of the present invention, the generating the mixed image data signal includes generating the mixed image data signal by mixing the original image data signal or the gray-adjusted original image data signal and the protection image data signal for each pixel unit or each sub-pixel unit.

In the present invention, the driving method may further include, before the generating the mixed image data signal, adjusting a gray value of the original image data signal or the protection image data signal within a gray range adjusted based on the gray data of the display panel.

After the gray adjusting, the driving method may further include mapping data of an original image data signal having the adjusted gray value or a protection image data signal having the gray-adjusted gray value for each dot or each pixel.

After the generating the mixed image data signal, the driving method may further include storing the generated mixed image data signal.

According to the present invention, unlike a normal image viewed from a front, a display device that can disturb readability of another person at side view is provided so that privacy protection or data security functions can be performed for a user of the display device.

Further, the present invention provides a display device that can perform privacy or data protection and security functions without adding a separated interference pixel, a dual display panel, and a complicated driving circuit, and a driving method.

BRIEF DESCRIPTION OF THE DRAWINGS

A more complete appreciation of the present invention, and many of the attendant advantages thereof, will become readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
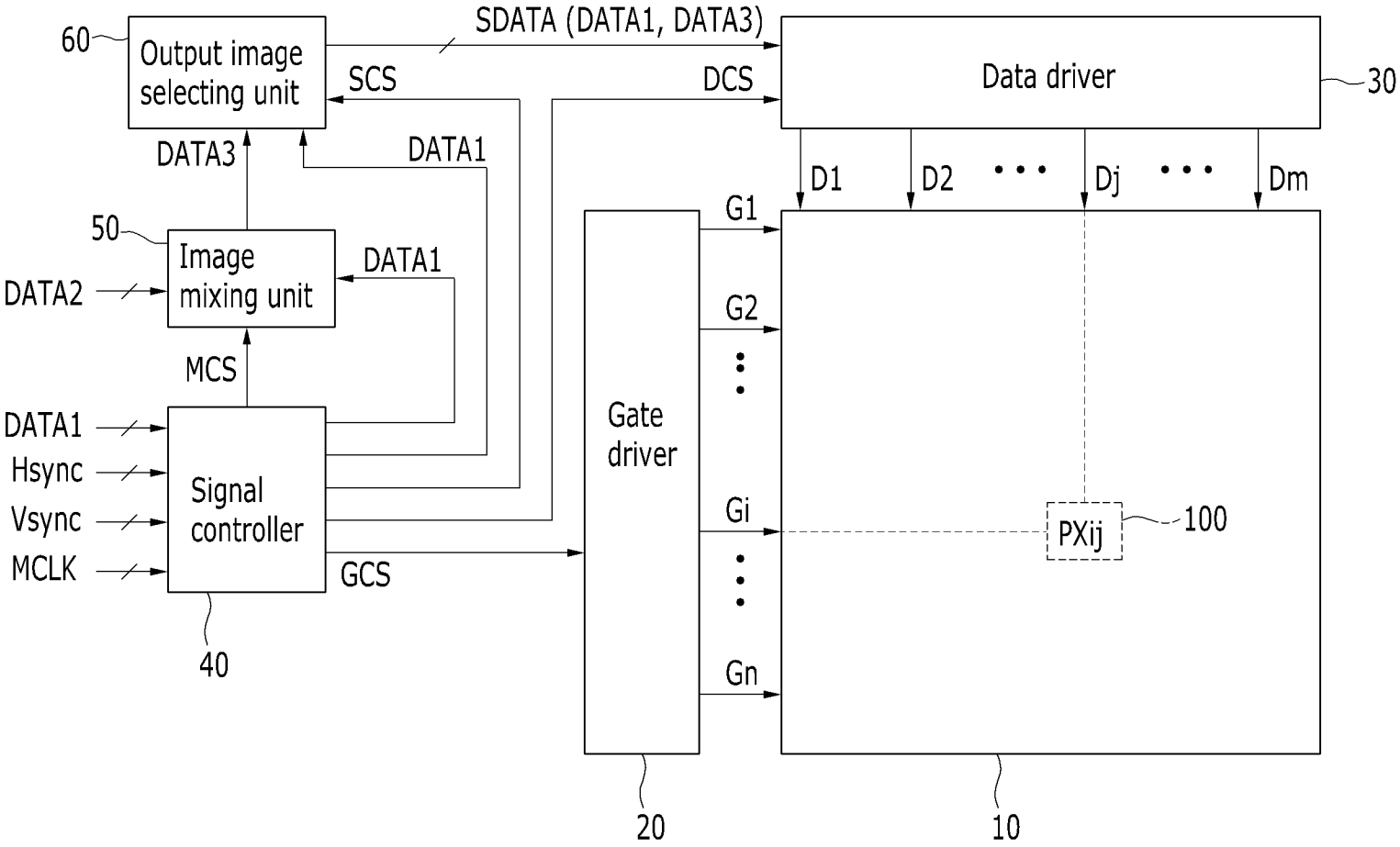
FIG. 1 is a block diagram of a viewing angle controllable display device according to an exemplary embodiment.

The present invention will be described more fully hereinafter with reference to the accompanying drawings, in which exemplary embodiments of the invention are shown. As those skilled in the art will realize, the described embodiments may be modified in various different ways, all without departing from the spirit or scope of the present invention.

In various exemplary embodiments, the same reference numerals are used for the elements having the same configuration and will be representatively described in a first exemplary embodiment, and in other exemplary embodiments, only elements different from those of the first exemplary embodiment will be described.

In order to clarify the present invention, parts that are not connected to the description will be omitted, and the same elements or equivalents are referred to as the same reference numerals throughout the specification.

Throughout this specification and the claims that follow, when it is described that an element is "coupled" to another element, the element maybe "directly coupled" to the other element or "electrically coupled" to the other element through a third element. In addition, unless explicitly described to the contrary, the word "comprise" and variations such as "comprises" or "comprising", will be understood to imply the inclusion of stated elements but not the exclusion of any other elements.

FIG. 1 is a block diagram of a viewing angle controllable display device according to an exemplary embodiment.

Referring to FIG. 1, the viewing angle controllable display device includes a display panel 10 including a plurality of pixels 100, a gate driver 20, a data driver 30, and a signal controller 40 controlling the display panel 10, the gate driver 20, and the data driver 30. The display device according to the exemplary embodiment further includes an image mixing unit 50 for generating viewing image data by receiving a control signal MCS from the signal controller 40 and an output image selecting unit 60.

The display panel 10 includes a plurality of pixels 100 disposed at areas where a plurality of gate lines G1 to Gn and a plurality of data lines D1 to Dm cross each other.

Each of the plurality of pixels 100 may be formed of sub-pixels (not shown) of red, green, and blue colors.

Each of the plurality of pixels 100 is connected to the corresponding gate line among the plurality of gate lines G1 to Gn and the corresponding data line among the plurality of data lines D1 to Dm, and they are arranged in a matrix format.

The plurality of gate lines G1 to Gn may extend in a row direction of the plurality of pixels 100 and the plurality of data lines D1 to Dm may extend in a column direction of the plurality of pixels 100, and they may be almost parallel with each other.

The display panel 10 may be formed as a liquid crystal display panel or a flat panel display panel, and it is not restrictive. Preferably, a viewing angle control function of the present exemplary embodiment may be well realized in case of the liquid crystal display panel.

The gate driver 20 is controlled by a gate driving control signal GCS of the signal controller 40, and generates and transmits a plurality of gate signals to the plurality of gate lines G1 to Gn connected to the display panel 10.

The gate driver 20 may include a shift register that sequentially generates a plurality of gate signals responding to a start signal among the date driving control signal GCS from the signal controller 40 and a level shift for shifting a voltage level of the plurality of gate signals to a level that is appropriate for driving of the plurality of pixels 100.

The data driver 30 samples an image data signal SDATA according to a data driving control signal DCS supplied from the signal controller 40, latches the sampled image data signal SDATA per line, converts the latched image data signal to a gamma voltage, and supplies the image data signal SDATA converted to the gamma voltage to a pixel selected by the gate signal among the plurality of pixels 100 through the data line in the type of analog signal.

In this case, the image data signal SDATA transmitted to the data driver 30 is an image data signal selected through the output image selecting unit 60 of the viewing angle controllable display device according to the exemplary embodiment.

That is, the image data signal SDATA may be an original image data signal DATA1 supplied from an external source to the display device of the present exemplary embodiment. Alternatively, the image data signal SDATA may be a mixed image data signal DATA3 selected by the output image selecting unit 60, which is an image data mixing the original image data signal DATA1 and a protection image data signal DATA2 separately prepared for privacy protection or information protection.

In the present exemplary embodiment, the original image is an image that realized on the display panel by information or an image data signal that a user wants to view.

The protection image is an image that is separately prepared for the purpose of protection of information or an image that the user wants to view such that another person cannot read or recognize the information or image.

In addition, the mixed image is realized as a mixed image of the original image and the protection image, displayed as one image on the display.

The signal controller 40 is connected with the gate driver 20 and the data driver 30, and generates control signals GCS and DCS for controlling the gate driver 20 and the data driver 30 by receiving the image signal DATA1, a horizontal synchronization signal (Hsync), a vertical synchronization signal (Vsync), and a clock signal (MCLK) from an external source and transmits the control signals GCS and DCS to the gate driver 20 and the data driver 30.

In this case, the video signal DATA1 is defined as a pure original image data signal that has not be treated or processed for grayscale adjustment or privacy protection.

The signal controller 40 may receives an RGB image signal including grayscale data of red R, green G, and blue B as the original image data signal DATA1. The signal controller 40 may transmit the original image data signal DATA1 to the image mixing unit 50 or may directly transmit the same to the output image selecting unit 60.

The original image data signal DATA1 transmitted to the image mixing unit 50 is mixed with an addition protection image data signal DATA2 that is provided as privacy protection or data protection to perplex assurance of a viewing angle, and the mixture may be generated as a mixed image data signal DATA3.

Meanwhile, the original image data signal DATA1 transmitted to the output image selecting unit 60 may be selected by the output image selecting unit 60 and then transmitted to the data driver 30. In this case, a normal original image may be displayed as an image according to a data voltage that depends on the original image data signal DATA1 transmitted to the display panel 10 through the data driver 30.

When the image data signal selected by the output image selecting unit 60 is the mixed image data signal DATA3, data included in the original image is displayed as an a mixed image that cannot be easily recognized by another person on the display panel 10, and accordingly, data or privacy of a user of the display device can be protected.

In addition, the signal controller 40 generates an image selection control signal SCS for selection and output of an image data signal of the output image selecting unit 60 and transmits the image selection control signal SCS to the output image selecting unit 60 such that the user can select an image to be realized on the display panel 10 for privacy protection by limiting readability of another person.

The image mixing unit 50 receives the original image data signal DATA1 transmitted from the signal controller 40 and an additionally prepared protection image data signal DATA2.

The image mixing unit 50 performs gray adjustment respectively on the original image data signal DATA1 and the protection image data signal DATA2 or adjusts grays of the protection image data signal DATA2 only to change data.

A mixed image data signal DATA3 can be generated by combining the changed original image data signal DATA1 and the protection image data signal DATA2.

The mixed image data signal DATA3 is transmitted to the output image selecting unit 60.

The output image selecting unit 60 selects an image data signal SDATA to be output among the mixed image data signal DATA3 and the original image data signal DATA1 using the image selection control signal SCS transmitted from the signal controller 40 and transmits the selected signal to the data driver 30.

In the exemplary embodiment of FIG. 1, the signal controller 40, the image mixing unit 50, and the output image selecting unit 60 are separately disposed, but they may be integrally formed as one control device.

According to the display device of FIG. 1, the user can check an output image selected by the output image selecting unit 60 through the display panel 10.

Figure 2:
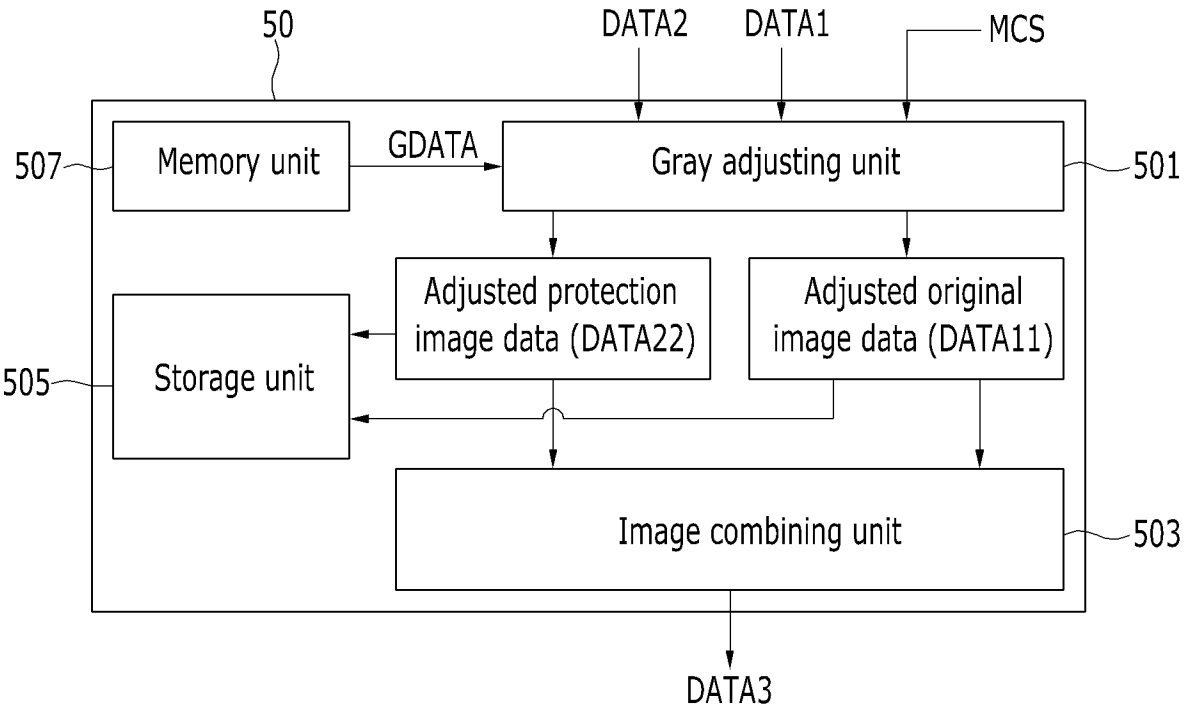
FIG. 2 is a detailed block diagram of an image mixing unit of the display device of FIG. 1.

FIG. 2 is a block diagram of a structure of the image mixing unit 50 of the display device shown in FIG. 1.

As shown in FIG. 2, the image mixing unit 50 according to the present exemplary embodiment includes a gray adjusting unit 501, an image combining unit 503, a storage unit 505 and a memory unit 507.

After receiving the control signal MCS, the gray adjusting unit 501 receives the original image data signal DATA1 transmitted from the signal controller 40 of FIG. 1 and the protection image data signal DATA2 additionally generated and supplied for privacy protection, and adjusts grays with reference to panel gray data GDATA stored in the memory unit 507.

The original image data signal DATA1 may be directly input to the image combining unit 503 without gray adjustment according to another exemplary embodiment. The gray adjustment of the original image data signal DATA1 may be determined by an automatic setup or a user selection option.

As brightness data according to grays of the display panel 10, panel gray data GDATA may be stored in the memory unit 507, and may be extracted from the memory unit 507 and used for data modulation in the gray adjusting unit 501.

The gray adjusting unit 501 modulates the input original image data signal DATA1 based on the panel gray data GDATA and generates an adjusted original image data signal DATA11. Depending on exemplary embodiments, the original image may not be modified.

The gray adjusting unit 501 modulates the input protection image data signal DATA2 based on the panel gray data GDATA and generates an adjusted protection image data signal DATA22.

The image data signals modulated in the gray adjusting unit 501 are respectively stored in the storage unit 505. The storage unit 505 can store data of the original image data signal DATA1, data of the gray-adjusted original image data signal DATA11, data of the protection image data signal DATA2, and data of the gray-adjusted protection image data signal DATA22.

The adjusted original image data signal DATA11 and the adjusted protection image data signal DATA22 are transmitted to the image combining unit 503 from the gray adjusting unit 501 and they are combined for each pixel or each sub-pixel.

Depending on exemplary embodiments, the original image data signal DATA1 that is not adjusted in the gray adjusting unit 501 and the adjusted protection image data signal DATA22 adjusted in the gray adjusting unit 510 may be combined by the image combining unit 503 for each pixel or each sub-pixel.

An image data signal combined by the image combining unit 503 and output therefrom is a mixed image data signal DATA3, and is transmitted to the output image selecting unit 60 of FIG. 1.

According to the exemplary embodiment, an image data signal is transmitted to the data driver 30, an image displayed on the display panel 10 corresponding to the image data signal may be selected among an original image or a mixed image combined for data protection or privacy protection, and viewing angle can be differently assured in one display panel 10 to thereby realize the original image and the mixed image can be displayed in the mixed manner.

The original image data signal DATA1 is image data formed of RGB data or YCbCr (YUV) to be viewed by a user. According to the color depth, each sub-pixel of, for example, an 8-bit image in RGB format has gray values of a range between 0 to 255.

The protection image data signal DATA2 is image data formed of RGB data or YCbCr (YUV) that are additionally prepared for protection of the original image data. Likely, according to the color depth, each sub-pixel of, for example, an 8-bit image in RGB format has gray values of a range between 0 to 255. That is, each sub-pixel of the protection image has gray values within the same gray value range of the original image, but it is not restrictive. That is, each sub-pixel of the protection image may have a gray value that is smaller than the gray value range of each sub-pixel of the original image.

Figure 3:
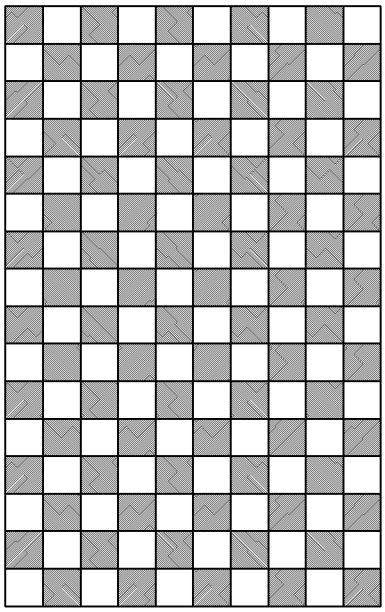
FIG. 3 shows an image state of a protection image used in driving of the viewing angle controllable display device according to the exemplary embodiment.

FIG. 3 exemplarily illustrates an image realized according to the protection image data signal DATA2 used for protection of data from the original image according to the exemplary embodiment.

FIG. 3 is an image according to an exemplary embodiment, and thus the present invention is not limited thereto.

When a protection image data signal DATA2 having the same image format shown in FIG. 3 is modulated by the gray adjusting unit 501 of the image mixing unit 50 of FIG. 2, the signal is modulated with reference to the panel gray data GDATA that represents brightness data according to the corresponding gray of the display panel 10.

Figure 4:
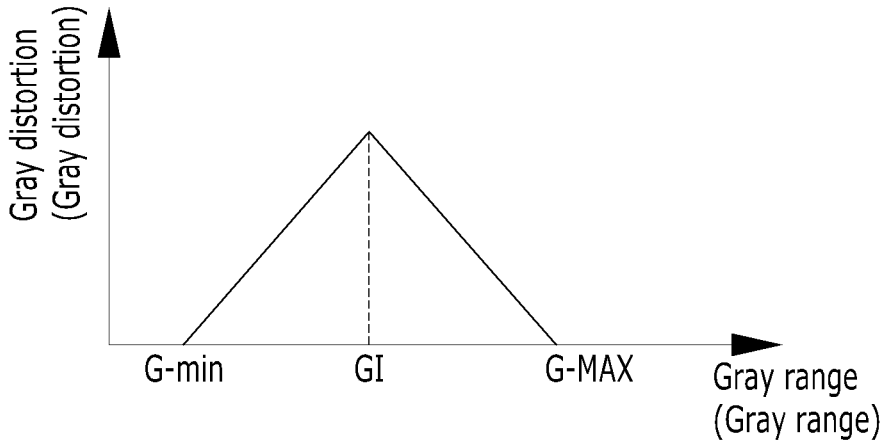
FIG. 4 is a graph illustrating a distortion level of panel grayscale information in a range that grayscale inversion occurs in a grayscale adjusting unit of FIG. 2.

FIG. 4 is an exemplarily graph illustrating a gray distortion level within a range that gray inversion occurs when image data is modulated with reference to the panel gray data GDATA in the gray adjusting unit 501 of FIG. 2.

Referring to FIG. 4, it can be observed that gray inversion occurs in the gray range of the display panel 10 and distortion is not frequently occurred during the gray inversion within a predetermined range including the maximum gray value or the minimum gray value of the gray range. That is, it can be observed that the minimum gray value G-min experienced gray inversion or the maximum gray value G-MAX experienced gray inversion are similar to or the same as the previous minimum gray value or the previous maximum gray value.

On the contrary, in the graph of FIG. 4, a gray value GI modulated from a gray value of a predetermined pixel or a predetermined sub-pixel according to input image data, included within the gray range of the display panel 10 is distorted in great depth.

The graph of FIG. 4 has a triangle shape, but it is not restrictive. With reference to the minimum gray value G-min experienced gray inversion or the maximum gray value G-MAX experienced gray inversion with low distortion, the graph may have any shape that can display high distortion of a gray value between the minimum gray value G-min and the maximum gray value G-MAX.

Figure 5:
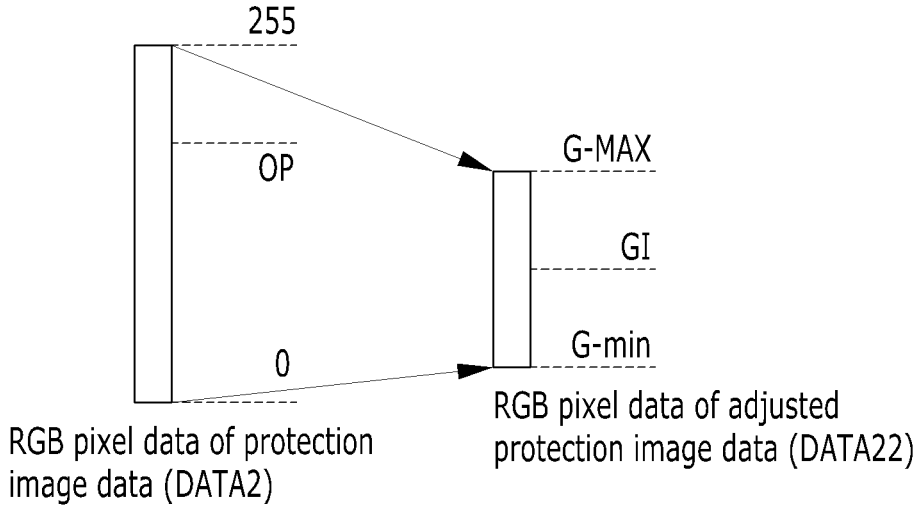
FIG. 5 exemplarily shows a method for adjusting image data in the grayscale adjusting unit of FIG. 2.

FIG. 5 exemplarily shows a method for adjusting image data in the grayscale adjusting unit 501 of FIG. 2.

Particularly, the graph of FIG. 4 shows a distortion level of the gray value modulated by using the image data adjusting method of FIG. 5.

Referring to FIG. 5, when image data of each RGB sub-pixel of the protection image transmitted to the display panel 10 has a predetermined gray value OP within the gray range between 0 to 255 and the gray adjusting unit 501 performs modulation for image mixing, a sub-pixel has a new gray value GI adjusted within the minimum gray value G-min experienced gray inversion and the maximum gray value G-MAX experienced gray inversion. In this case, the width of distortion of before and after the gray inversion is increased in a gray value OP between the minimum value and the maximum value of 0 or 255 rather than a gray value of the maximum value or the minimum value of 0 or 255.

For example, when image data of each RGB sub-pixel of the protection image is input as a specific gray value OP (ex. 250 or 251) within the gray range of 0 to 255 to the gray adjusting unit 501, the specific gray value OP is modulated by the gray adjusting unit 501 and thus the gray value OP becomes a newly adjusted gray value GI.

In sub-pixel image data of 8-bit bit color depth, the minimum gray value 0 is adjusted to the minimum gray value G-min experiencing the gray inversion, and the maximum gray value 255 is adjusted to the maximum gray value G-MAX experiencing the gray inversion. In the case, the G-min may be equal to or greater than 0, and the G-MAX may be smaller than or equal to 255.

If the G-min is equal to 0 and the G-MAX is equal to 255, a gray range of image data, deformed by gray adjustment, becomes equal to the before-adjusted gray range, and this implies that the image data signal for image mixing can be used without modulation.

In the exemplary embodiment, the image data of the RGB pixel of the protection image is modulated to the gray value GI from the gray value OP within the range of 0 to 255, and the relationship therebetween is as given in Equation 1.

$$GI = \frac{OP(GMAX - Gmin)}{255} + Gmin \qquad \text{[Equation 1]}$$

GI: gray value of a sub-pixel of gray-adjusted protection image

OP: gray value of a sub-pixel of a protection image input to gray adjusting unit GMAX: maximum gray value gray-adjusted in gray data of display panel Gmin: minimum gray value gray-adjusted in gray data of display panel The gray adjusting unit 501 may use various operation methods other than the gray adjustment in Equation 1.

According to other operation equation, a maximum gray value G-MAX and a minimum gray value G-min gray-adjusted in gray data of a display panel and a middle gray value G-mid within a gray-adjusted gray range are used. A relationship between a gray value OP of a pixel or a sub-pixel of the protection image and a gray value PP modulated from the gray value OP by the gray adjusting unit is as given in Equation 2.

$$\text{when } OP > Gmid, \qquad \text{[Equation 2]}$$

$$PP = \frac{(OP - Gmid)(GMAX - Gmid)}{255 - Gmid} + Gmid$$

$$\text{when } OP < Gmid,$$

$$PP = Gmid - \frac{(Gmid - OP)(Gmid - Gmin)}{Gmid}$$

PP: gray value of a sub-pixel of a gray-adjusted protection image

OP: gray value of a sub-pixel of the protection image, input to the gray adjusting unit GMAX: maximum gray value gray-adjusted in the gray data of the display panel Gmin: minimum gray value adjusted in the gray data of the display panel Gmid: an intermediate gray value within a gray range gray-adjusted in the gray data of the display panel After grays of the protection image data or the original image data are adjusted using the method of FIG. 5, the image data is mixed by the image mixing unit 50 of the display device. In this case, the original image data may be mixed without being gray-adjusted.

Figure 6:
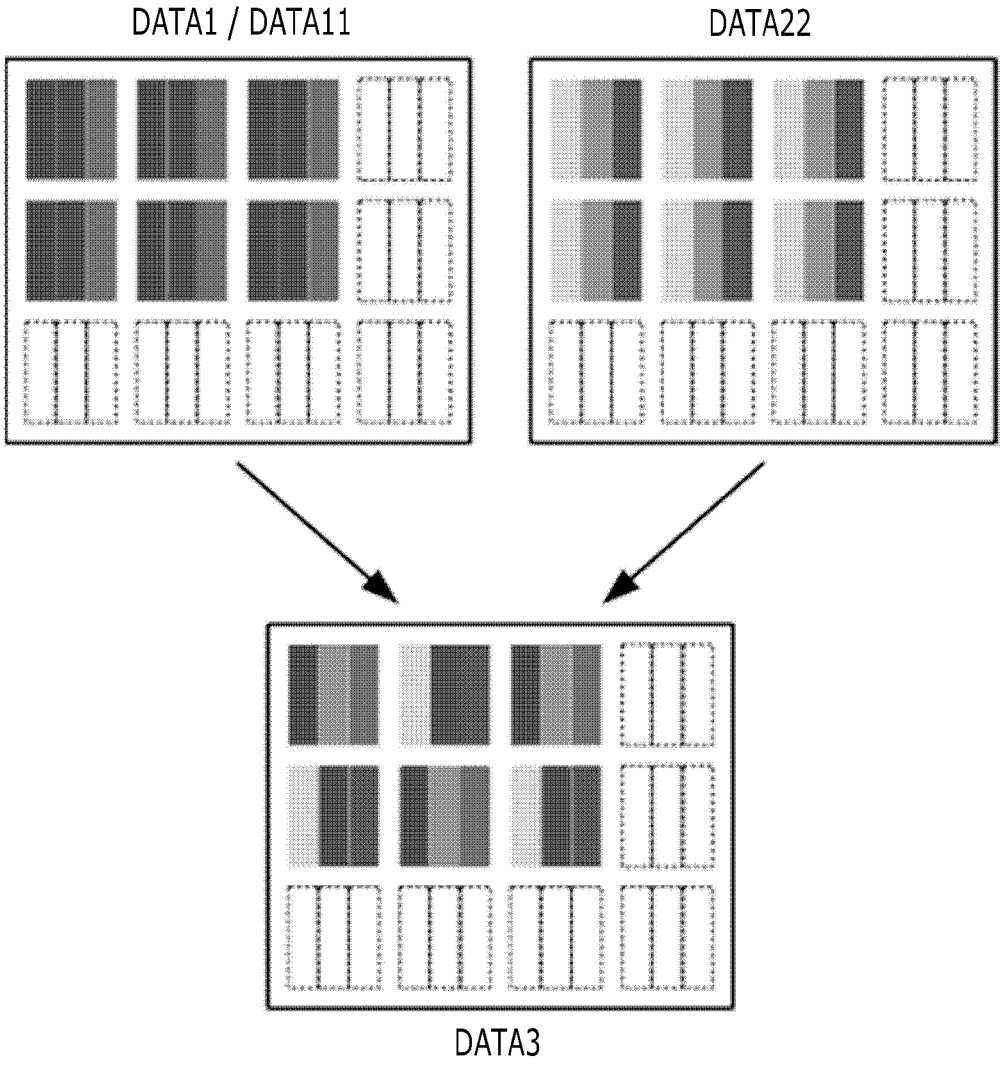
FIG. 6 exemplarily shows a mixing method of the image data in an image mixing unit of the display device of FIG. 1.

FIG. 6 illustrates a mixing method of image data according to the exemplary embodiment. Particularly, the original image data signal DATA1 adjusted by the gray adjusting unit 501 and the protection image data signal DATA22 adjusted by the gray adjusting unit 501 are mixed.

In further detail, the mixing method of FIG. 6 mixes image data of each RGB sub-pixel unit.

That is, the respective first and third sub-pixels of pixels in an even-numbered column even-numbered row and pixels in an odd-numbered column odd-numbered row of the original image data signal DATA1, or the adjusted original image data signal DATA11, and the respective second sub-pixel of pixels in an even-numbered column and even-numbered row and pixels in an odd-numbered column and odd-numbered row of the adjusted protection image data signal DATA22 are combined to form pixels in an even-numbered column even-numbered row and pixels in an odd-numbered column odd-numbered row of mixed image data DATA3. In addition, the respective second sub-pixels of pixels in an even-numbered column odd-numbered row and pixels in an odd-numbered column even-numbered row of the original image data signal DATA1, or the adjusted original image data signal DATA11, and the respective first and third sub-pixels of pixels in an even-numbered column odd-numbered row and pixels in an odd-numbered column even-numbered row of the adjusted protection image data signal DATA22 are combined to form pixels in an even-numbered column odd-numbered row and pixels in an odd-numbered column even-numbered row of the mixed image data DATA3. The mixed image data DATA3 is transmitted to the output image selecting unit 60 and selected by the output image selecting unit 60 such that a mixed image according to the mixed image data DATA3 is displayed on the display panel 10.

The image mixing method for each sub-pixel unit shown in FIG. 6 can be variously modified according to other exemplary embodiments.

The mixed image data DATA3 has the feature of the original image and the feature of the protection image including a gray inversion component. Thus, when the mixed image data DATA3 is selected and output, the feature of the original image can be viewed from the front of the display panel 10, but the gray-inverted protection image disturbs readability of data from a side of the display panel 10 so that data displayed on the display panel 10 cannot be viewed. That is, a readable viewing angle with respect to the display panel 10 can be controlled through output of the mixed image data DATA3. This, the display device having a privacy protection function can be driven and provided.

In the viewing angle controllable display device according to the exemplary embodiment, the user can select an original image or a mixed image using the output image selecting unit 60 so that an image displaying data can be variously realized. If data requires privacy protection of the user, the user can determine whether to output a mixed image mixed with a protection image or output an original image.

According to the exemplary embodiment, the user may determine whether the data can be read through the user-selected image realized on the display panel 10 such as a liquid crystal display panel or a flat display panel, as necessary.

Figure 7:
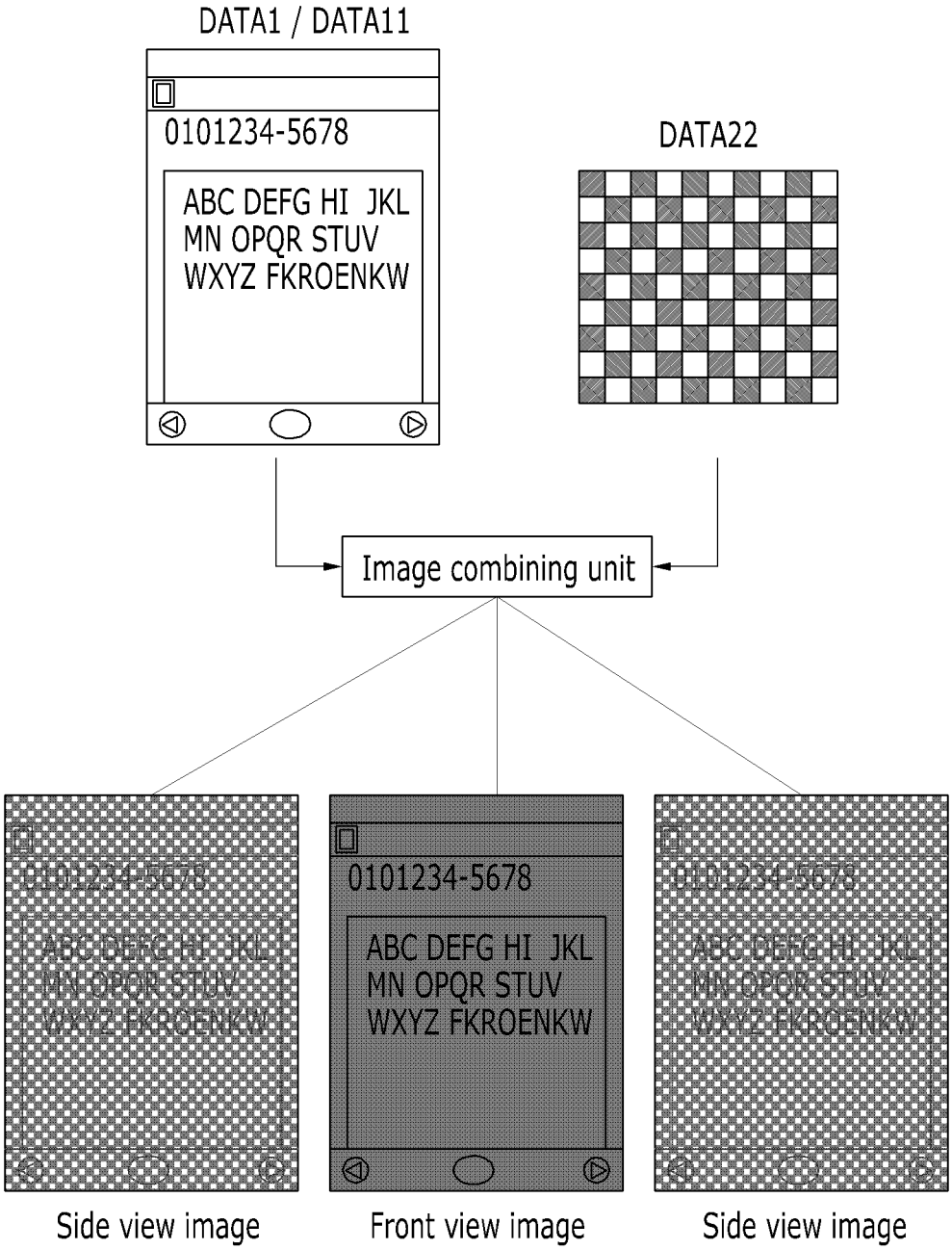
FIG. 7 is front and side and side image views of a display device, of which viewing angles can be controlled according to the exemplary embodiment.

FIG. 7 shows a mixed image, a front view image, and a side view image of the viewing angle controllable display device according to the exemplary embodiment.

An image according to the original image data signal DATA1 or the gray-adjusted original image data signal DATA11 is clearly realized as shown in FIG. 7. Thus, accurate data can be recognized by not only the user but also another person.

However, when the protection image data signal DATA22 adjusted for disturbing data recognition and protecting data is mixed, the mixed image data DATA3 is output, and an image displayed by the mixed image data DATA3 may have a readable viewing angle that is narrower than that of an image according to a normal original image.

Thus, since the viewing angle can be controlled, data can be accurately recognized from a front view, but the data cannot be read from a side view so that the data can be protected from another person.

According to the present invention, a user can protect an image or data by selecting, for example, a normal mode or a privacy mode as a driving mode of the display device.

Figure 8:
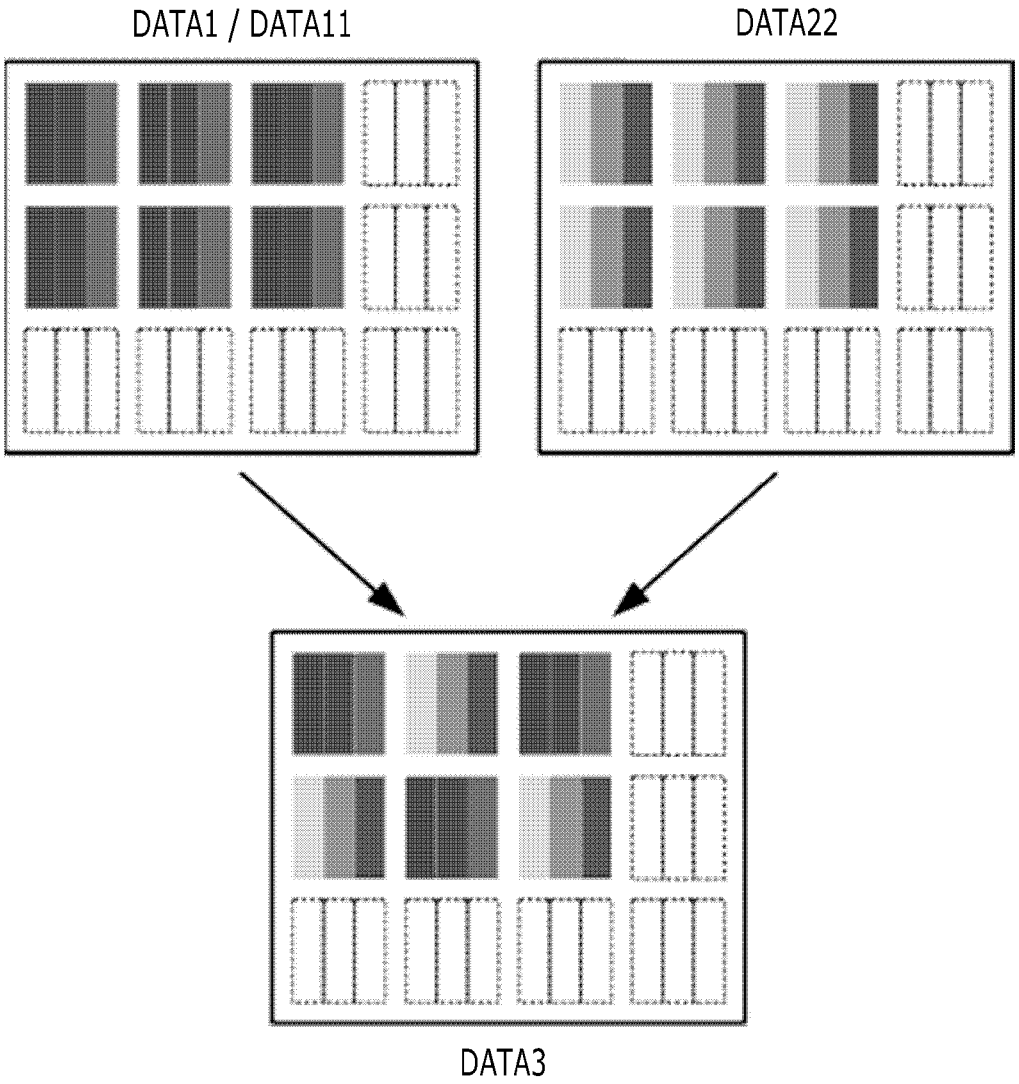
FIG. 8 shows another example of a mixing method of image data in an image mixing unit of the display device of FIG. 1.

FIG. 8 shows a mixing method of image data in the image mixing unit of the display device of FIG. 1, according to another example.

In further detail, according to the mixing method of FIG. 8, the mixing can be performed to form pixels of the mixed image data DATA3 by one pixel unit, not by RGB sub-pixel unit.

That is, referring to FIG. 8, pixels in an even-numbered column even-numbered row and pixels in an odd-numbered column odd-numbered row of the original image data signal DATA1, or the adjusted original image data signal DATA11, and pixels in an even-numbered column odd-numbered row and pixels in an odd-numbered column even-numbered row of the adjusted protection image data signal DATA22 are combined such that the mixed image data DATA3 is generated. The mixed image data DATA3 is transmitted to the output image selecting unit 60 and then selected by the output image selecting unit 60, and a mixed image according to the mixed image data DATA3 is displayed on the display panel 10.

The method for generating the mixed image data DATA3 for each pixel is not limited to the method of FIG. 8. That is, the level of using of the pixels of the adjusted protection image data signal DATA22 in the mixed image data DATA3 may be controlled according to a protection level of the privacy protection function. When the privacy protection level is low, density (i.e. the level of using) of pixels of the adjusted protection image data signal DATA22 may be set to be lower compared to the original image data signal DATA1, or the adjusted original image data signal DATA11, to thereby set the mixed image to be further similar to the original image.

According to the present invention, convenience of operation of the display device enables the user to control or select the data protection or privacy protection level of the display device.

While this disclosure has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

A person having ordinary skill in the art can change or modify the described embodiments without departing from the scope of the present invention, and it will be understood that the present invention should be construed to cover the modifications or variations.

Further, the material of each of the constituent elements described in the specification can be readily selected from among various known materials and replaced thereby by a person having ordinary skill in the art.

Further, a person having ordinary skill in the art can omit some of the constituent elements described in the specification without deteriorating performance or can add constituent elements in order to improve performance.

In addition, a person having ordinary skill in the art may change the sequence of the steps described in the specification according to process environments or equipment.

Accordingly, the scope of the present invention should be determined not by the above-described exemplary embodiments, but by the appended claims and their equivalents.

What is claimed is:

1. A viewing angle controllable display device comprising:

an image mixing unit generating a mixed image data signal by mixing an original image data signal, or a gray-adjusted original image data signal, with a protection image data signal that disturbs recognition of the original image;

an output image selecting unit receiving both the original image data signal and the mixed image data signal and optionally selecting one of the original image data signal and the mixed image data signal for output to a display panel; and a display panel responding to gate signals sequentially transmitted from a gate driver, and receiving a data voltage corresponding to the original image data signal or the mixed image data signal selected from the output image selecting unit through a data driver, and displaying an original image or a mixed image, the protection image data signal having a gray value modulated within a gray range adjusted based on panel gray data that resides within a memory and used by the display device to indicate an acceptable range of gray values to process.

2. The display device of claim 1, wherein a viewing angle of the mixed image is narrower than that of the original image.

3. The display device of claim 1, wherein the display panel displaying the mixed image has a limit of readability in a side-viewed image.

4. The display device of claim 1, wherein the mixed image data signal is generated by mixing the original image data signal, or the gray-adjusted original image data signal, with the protection image data signal for each pixel unit or each sub-pixel unit.

5. The display device of claim 1, wherein the image mixing unit comprises:

a gray adjusting unit adjusting a gray value of the original image data signal or the protection image data signal, within a gray-adjusted gray range based on panel gray data; and an image combining unit generating the mixed image data signal by mixing the gray-adjusted protection image data signal having a gray value adjusted by the gray adjusting unit with the original image data signal, or with the gray-adjusted original image data signal having a gray value adjusted by the gray adjusting unit.

6. The display device of claim 5, wherein the image combining unit generates the mixed image data signal by combining the protection image data signal with the original image data signal, or with the gray-adjusted original image data signal for each pixel unit or each sub-pixel unit.

7. The display device of claim 5, wherein the image mixing unit further comprises a storage unit storing data of an original image data signal, data of the gray-adjusted original image data signal, data of the protection image data signal, and data of the gray-adjusted protection image data signal.

8. The display device of claim 1, wherein the display panel is a liquid crystal display panel or a flat display panel.

9. The display device of claim 1, further comprising a controller generating and transmitting an image selection control signal that controls selection of an image data signal to be displayed on the display panel to the output image selecting unit.

10. A driving method of a viewing angle controllable display device, comprising:

storing panel gray data for gray-adjusting to a memory unit;

generating a mixed image data signal by mixing an original image data signal, or a gray-adjusted original image data signal modulated based on the panel gray data, with a protection image data signal that disturbs recognition of the original image;

applying both the original image data signal and the mixed image data signal to a selecting unit and selecting an output image data signal corresponding to an image output on the display panel among the original image data signal and the mixed image data signal; and displaying an image according to the selected output image data signal on the display panel, the protection image data signal having a gray value modulated within a gray range modulated based on the panel gray data stored in the memory unit and used by the display device to indicate an acceptable range of gray values to process.

11. The driving method of claim 10, wherein, when the mixed image data signal is selected as the output image data signal, a viewing angle of a mixed image displayed according to the mixed image data signal is limited.

12. The driving method of claim 11, wherein the mixed image displayed according to the mixed image data signal has a limit of readability in a side-viewed image.

13. The driving method of claim 11, wherein a viewing angle of the mixed image displayed according to the mixed image data signal is narrower than that of an original image.

14. The driving method of claim 10, wherein the mixed image data signal is generated by combining the original image data signal or the gray-adjusted original image data signal, with the protection image data signal for each pixel unit or each sub-pixel unit.

15. The driving method of claim 10, further comprising, before the generating the mixed image data signal, adjusting a gray value of the original image data signal or the protection image data signal within a gray range adjusted based on the panel gray data.

* * * * *